US008424275B2

(12) United States Patent
Schneider

(10) Patent No.: US 8,424,275 B2
(45) Date of Patent: Apr. 23, 2013

(54) SEALED PLASTIC CLOSURE AND METHOD FOR MAKING THE SAME

(75) Inventor: Wayne F. Schneider, Olathe, KS (US)

(73) Assignee: Huhtamaki, Inc., De Soto, KS (US)

( * ) Notice: Subject to any disclaimer, the term of this patent is extended or adjusted under 35 U.S.C. 154(b) by 430 days.

(21) Appl. No.: 12/707,759

(22) Filed: Feb. 18, 2010

(65) Prior Publication Data

US 2010/0146911 A1 Jun. 17, 2010

Related U.S. Application Data

(62) Division of application No. 11/875,424, filed on Oct. 19, 2007, now abandoned.

(51) Int. Cl.
*B65B 51/10* (2006.01)

(52) U.S. Cl.
USPC ..... 53/478; 53/287; 53/485; 53/486; 53/488

(58) Field of Classification Search ..... 53/478, 53/485, 486, 488, 489, 331, 366, 287
See application file for complete search history.

(56) References Cited

U.S. PATENT DOCUMENTS

| | | | | |
|---|---|---|---|---|
| 3,428,238 | A * | 2/1969 | Rapp et al. | 229/5.6 |
| 3,688,464 | A | 9/1972 | Fox | |
| 4,975,132 | A | 12/1990 | Thompson | |
| 5,032,213 | A | 7/1991 | Thomas, Jr. | |
| 5,115,938 | A | 5/1992 | Thompson | |
| 5,566,529 | A * | 10/1996 | Sireix | 53/412 |
| 6,564,531 | B2 * | 5/2003 | Beck | 53/478 |

FOREIGN PATENT DOCUMENTS

| | | | |
|---|---|---|---|
| DE | 2129805 | A1 | 12/1972 |
| GB | 400353 | A | 10/1933 |

* cited by examiner

*Primary Examiner* — Thanh Truong
(74) *Attorney, Agent, or Firm* — Husch Blackwell LLP

(57) ABSTRACT

A sealed plastic container and a method for producing it are provided. The method for producing the sealed plastic container includes the steps of providing a container body having an end, providing a closure member having a skirt, inserting the closure member into the container body, heating the closure member skirt and container body end, and rolling the closure member skirt top and container end inward thereby fusing the closure member to the container body.

14 Claims, 7 Drawing Sheets

SEALED PLASTIC CLOSURE AND METHOD FOR MAKING THE SAME

CROSS-REFERENCE TO RELATED APPLICATIONS

This application is a Divisional of and claims priority to U.S. application Ser. No. 11/875,424 filed Oct. 19, 2007 to Wayne F. Schneider entitled "Sealed Plastic Closure And Method For Making The Same," now abandoned, the entire disclosure of which is incorporated herein by reference.

BACKGROUND OF THE INVENTION

Methods of sealing plastic components together are widely used in the packaging industry. The current methods used to seal plastic components together include ultrasonic sealing and impulse sealing. Both ultrasonic sealing and impulse sealing require that two surfaces be clamped together in order for the sealing process to occur.

The ultrasonic sealing and impulse sealing processes have limited application when used to seal the tops of containers where a full 360-degree seal is desired. Their limited application is due to the requirement that the two surfaces must be clamped together. In order to create a seal around the periphery of a container, a container closure member or plug would have to be clamped to the container sidewall continuously around the entire periphery of the container sidewall. In order to clamp a plug to the container sidewall, an inner backup tool would have to be placed inside of the plug opening and an outer clamping tool would have to be placed outside of the container sidewall.

The inner backup tool placed inside of the plug opening would have to be split in order to get inside of the plug opening while not dislodging the plug from its position within the container sidewall. Once the split backup tool is within the plug opening, it would have to expand to a diameter approximately equal to the inside diameter of the plug. This expansion of the inner split backup tool would create gaps between its segments thereby leaving areas of the plug and container sidewall which do not get clamped together and are not sealed. Therefore, a full 360-degree seal is not formed.

Accordingly, a need exists for a method of sealing plastic containers in which a full 360-degree seal can be formed.

SUMMARY OF THE INVENTION

The present invention is directed to a method for producing a sealed plastic container that includes the steps of providing a container body having an end, providing a closure member having a skirt, inserting the closure member into the container body, heating the closure member skirt and container body end, and rolling the closure member skirt top and container end inward thereby fusing the closure member to the container body.

The present invention is also directed to a sealed plastic container that includes a sidewall having an open end configured for receiving a closure member and a closure member having a closure panel and an annular skirt extending therefrom. The closure member is positioned inside of the sidewall such that the closure member annular skirt is adjacent the sidewall open end. The closure member annular skirt and the sidewall open end are rolled inward and fused together to seal the sidewall open end.

DESCRIPTION OF THE SEVERAL VIEWS OF THE DRAWINGS

Further features of the present invention will become apparent to those skilled in the art to which the present invention relates from reading the following description with reference to the accompanying drawings, in which.

DETAILED DESCRIPTION OF THE INVENTION

Figure 1:
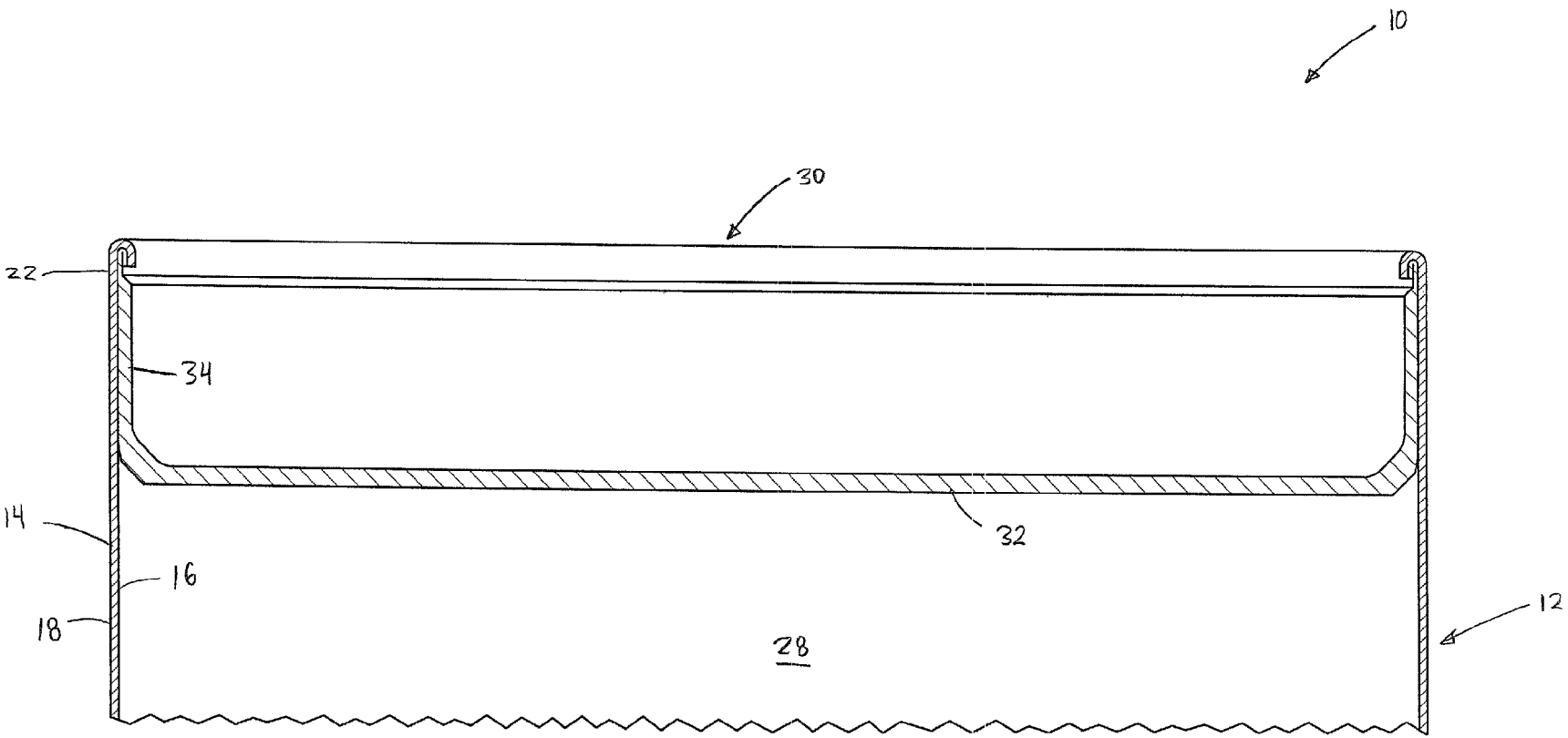
FIG. 1 is an enlarged fragmentary sectional view showing the container body sidewall and closure member skirt rolled over thereby sealing an open end of the container in accordance with one embodiment of the present invention.
Figure 3:
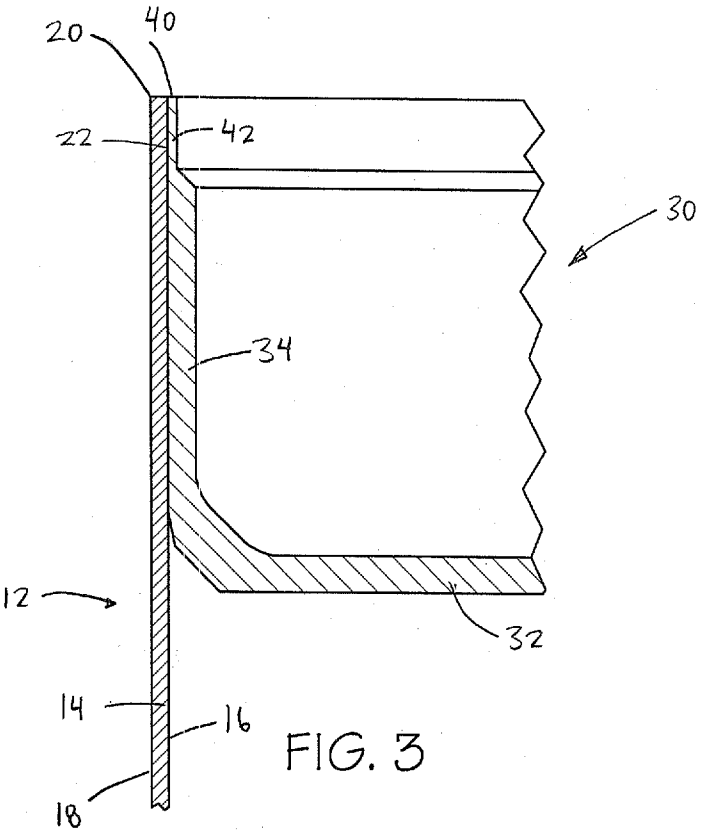
FIG. 3 is an enlarged fragmentary sectional view showing a closure member positioned within the container body in accordance with one embodiment of the present invention.
Figure 2:
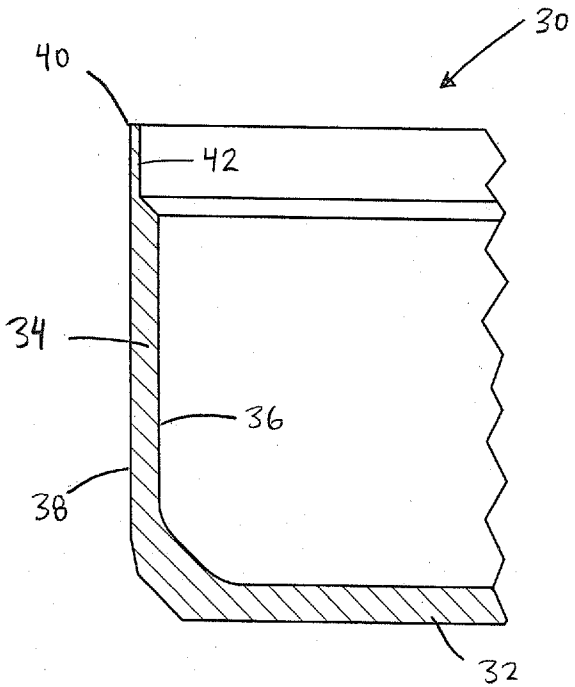
FIG. 2 is an enlarged fragmentary sectional view of the closure member in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

An embodiment of the present invention is directed to a sealed plastic closure 10 and the method for making it. As illustrated in FIG. 1, the sealed plastic closure 10 is generally comprised of a container body 12 having a sidewall 14 and a closure member or plug 30. In the sealing process, the container body sidewall 14 and closure member 30 are rolled inward.

The container body 10 is comprised of a sidewall 14 having an interior surface 16, an exterior surface 18, and two ends 22, 24. The two ends 22, 24 and the sidewall 14 define a storage chamber 28 adapted for storing food products and the like. In one embodiment, both ends 22, 24 may be open and suitable being sealed in accordance with the present invention. In another embodiment, one end 24 may be closed by an end wall 26. In one embodiment, the sidewall 14 is generally cylindrical both internally and externally. However, it is to be understood that other, non-round cross-sectional shapes can be utilized. The sidewall 14 may be formed by extrusion, injection molding, or may be convolutedly wrapped and sealed to form an overlapping side seam. Preferably, the sidewall 14 is made of a polypropylene material having a material thickness on the order of about 0.015 to about 0.023 inches. The material used to construct the sidewall 14 may also contain additives, such as calcium carbonate and polyethylene, to increase the sidewall's 14 flexibility characteristics.

The closure member 30 includes a panel or wall 32 and an annular skirt 34 extending generally perpendicular therefrom. The annular skirt 34 has an interior surface 36, an exterior surface 38, and a top edge 40. Proximate the top edge 40, the annular skirt 34 has an area of reduced thickness forming a thin flange 42. The thin flange 42 circumscribes the entire periphery of the annular skirt 34. The thin flange 42 is provided to help facilitate the process of sealing the closure member 30 to the sidewall 14 as will be discussed further below. In one embodiment, the closure member wall 32 and an annular skirt 34 are generally cylindrical. Again, however, other, non-round cross-sectional shapes can be utilized. The closure member 30 may be formed by extrusion or injection molding. Preferably, the closure member 30 is made of a polypropylene material having a material thickness on the order of about 0.035 inches. The thickness of the thin flange 42 is preferably on the order of about 0.010 inches. The material used to construct the closure member 30 may also contain additives, such as calcium carbonate and polyethylene, to increase the closure member's 30 flexibility characteristics.

Figure 4A:
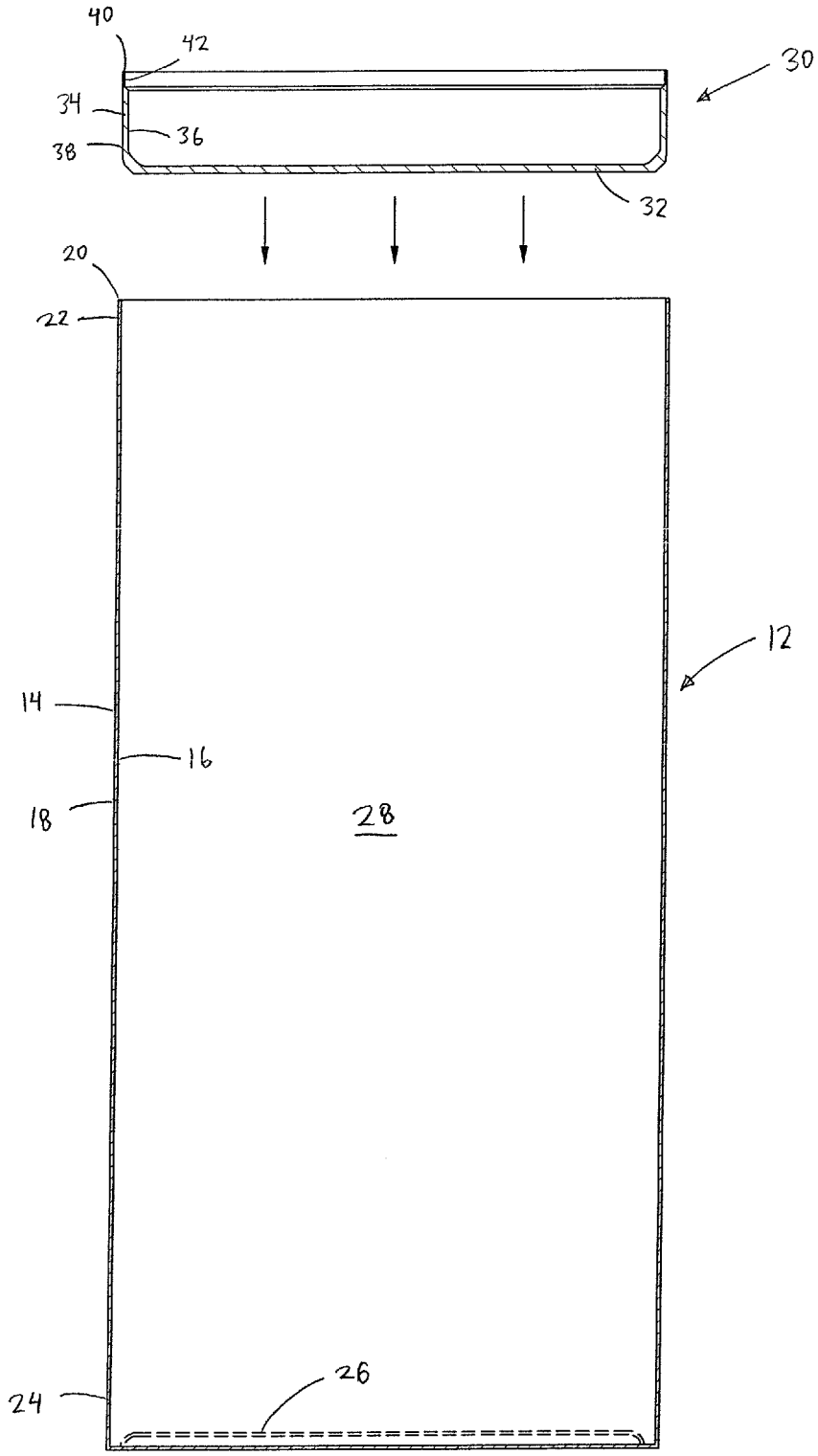
FIG. 4A is a front sectional view showing a closure member being inserted into the container body in accordance with one embodiment of the present invention.
Figure 4B:
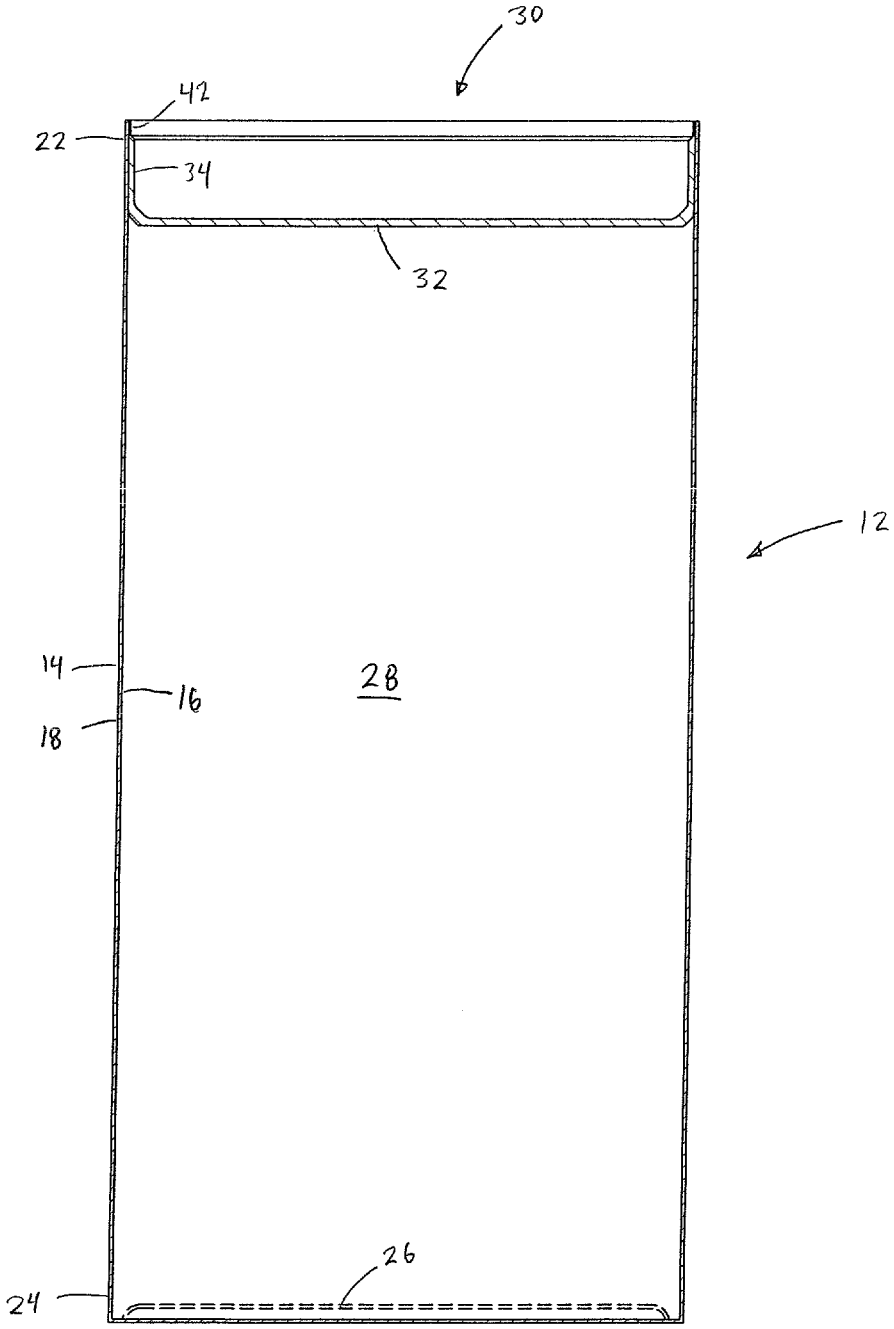
FIG. 4B is a front sectional view showing a closure member positioned within the container body in accordance with one embodiment of the present invention.

In the method of making a sealed plastic container 10, a closure member 30 is inserted into the container body 12, as shown in FIG. 4A. As illustrated in FIG. 4B, the closure member 30 is oriented within the container body sidewall 14 such that its wall portion 32 is positioned within in the sidewall and its flange portion 42 is located proximate a sidewall end 22. Preferably, the closure member top edge 40 is substantially flush with the end of the sidewall 14.

Figure 4C:
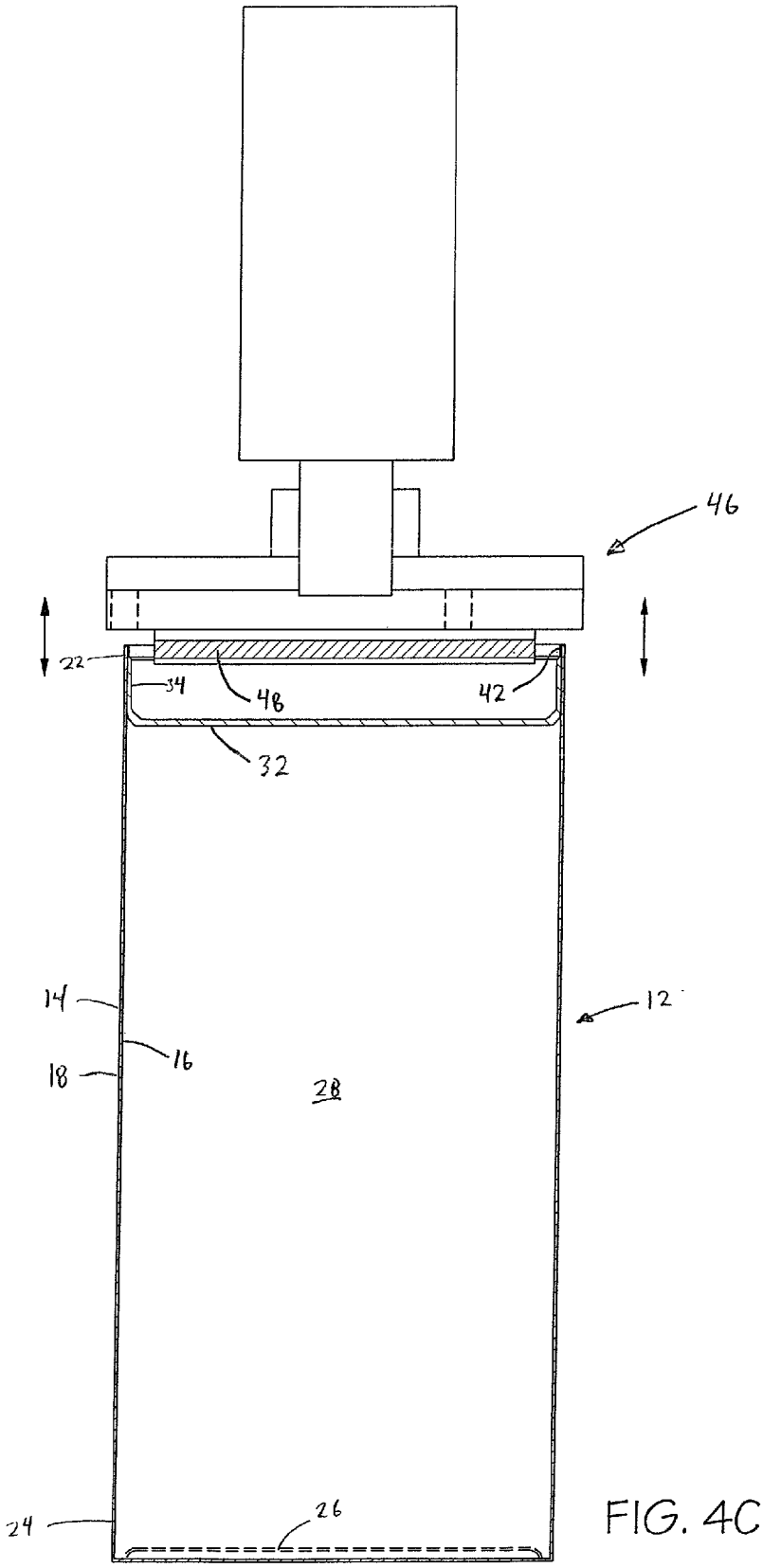
FIG. 4C is a front sectional view showing a heater head positioned to apply heated air to the closure member and container body in accordance with one embodiment of the present invention.

Once the closure member 30 is properly positioned within the sidewall 14, the thin flange 42 and sidewall end 22 are heated. In one embodiment, the thin flange 42 and sidewall end 22 are heated through the application of heated air. As shown in FIG. 4C, a heater head 46 having an air distribution manifold 48 is lowered about the sidewall 14 and closure member 30. The air distribution manifold 48 has horizontally oriented orifices (not shown) through which the heated air is distributed. The orifices are positioned about the air distribution manifold 48 such that the heated air flows outward in a 360-degree pattern. As shown, the air distribution manifold 48 is positioned at a level such that it is vertically centered about the closure member's thin flange portion 42. Thus, the air distribution manifold 48 is positioned such that its orifices will direct the heated air toward the thin flange 42. Once the heater head 46 is in place, heated air, at a temperature of approximately 370 to 390 degrees Fahrenheit, is applied to the thin flange 42. The heated air is applied for approximately five to seven seconds. It will be appreciated by one skilled in the art that the air temperature and duration for which the heated air is applied can be varied. For example, if warmer air is applied, the duration will be shorter. If cooler air is applied, the duration will be longer.

Through conduction, a portion of the heat that is applied to the closure member's thin flange portion 42 transfers to the adjacent sidewall end 22. When the heated air is applied, the thin flange area 42 will begin to melt and the adjacent sidewall end 22 will soften, but not totally melt. In another embodiment, heated air is applied to the sidewall exterior surface 18 rather than the closure member flange 42. In that embodiment, a portion of the heat applied to the sidewall 14 will transfer to the closure member flange 42. As eluded above, the closure member 30 is provided with a thin flange 42 so that the material of the closure member 30 will melt faster than the material of the sidewall 14. As further described below, this helps facilitate the process of sealing the closure member 30 to the sidewall 14. During the heating process, the closure member 30 and sidewall 14 begin to fuse together.

Figure 4D:
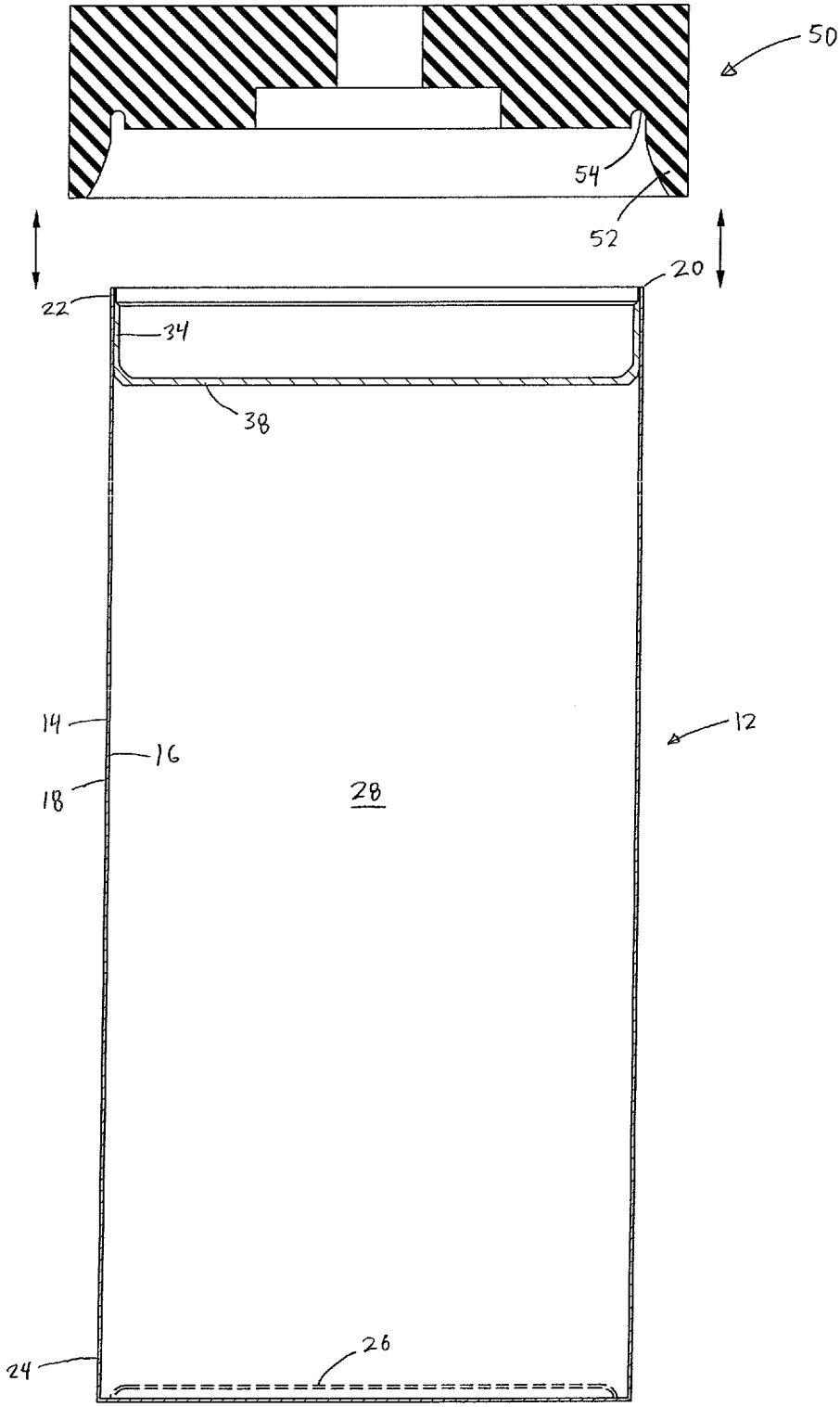
FIG. 4D is a front sectional view showing a die being placed over the closure member and container body in order to roll the closure member skirt and container body sidewall inward in accordance with one embodiment of the present invention.
Figure 4E:
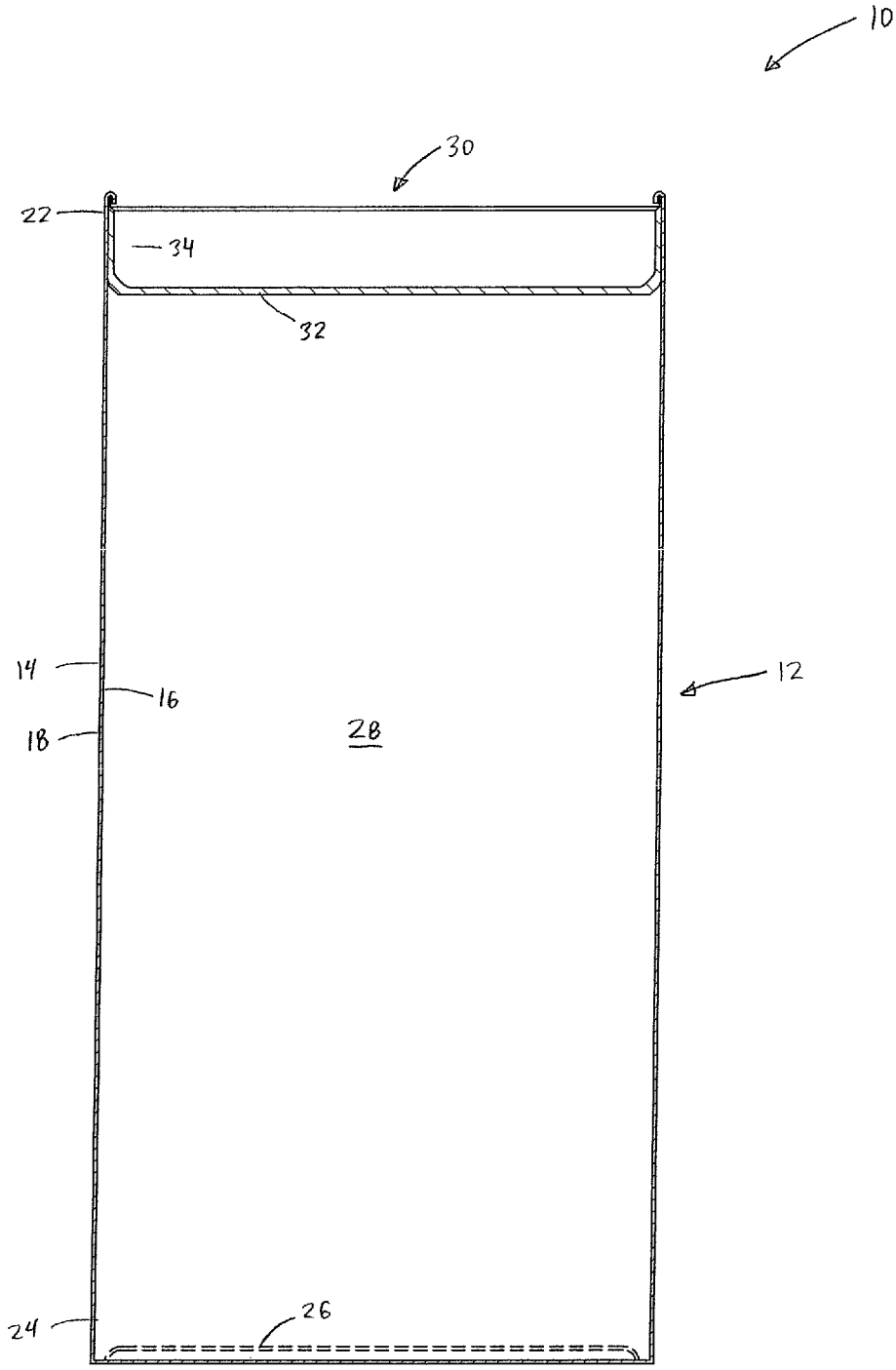
FIG. 4E is a front sectional view of a container body with an open end sealed by a closure member in accordance with one embodiment of the present invention.

Once the closure member 30 and sidewall 14 are heated, they are both rolled inward to create a seal. As illustrated in FIG. 4D, a die 50 is lowered onto the closure member 30 and sidewall 14. The die 50 has a profile that facilitates the rolling of the closure member flange 42 and the sidewall 14. As shown in FIG. 4D, the outermost portion of the die 50 is an inwardly sloping wall 52 circumscribing its entire periphery. The inwardly sloping wall 52 guides the container body 12 and closure member 30 assembly into alignment with the die 50. At its uppermost portion, the inwardly sloping wall 52 terminates in a radius 54. When the radius 54 meets the top, outer edge 20 of the sidewall, the sidewall end 22 and closure member flange 42 begin to roll inward. This inward rolling action continues until the closure member flange 42 is rolled around and back onto itself like seen in FIG. 1. During this rolling action, the molten material of the closure member flange 42 and the softened material of the sidewall end 22 fuse together due to the relatively small size of the radius 54. This fusing creates a seal between the closure member flange 42 and the sidewall end 22 that extends around their entire 360-degree periphery. FIG. 4E shows the resulting heat-sealed container that is formed in this process.

From the foregoing, it may be seen that the sealed plastic closure and the method for producing it is particularly well suited for the proposed usages thereof. Furthermore, since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

I claim:

1. A method of sealing plastic containers comprising the steps of:

providing a container body having a sidewall, a first end, and a second end;

providing a closure member having a base with a perimeter and a skirt extending generally perpendicular therefrom, said skirt terminating in a top edge;

inserting said closure member into said container body proximate at least one of said ends such that said skirt top edge is flush with one of said ends;

heating said skirt top edge and said container body end; and rolling said skirt top edge and said container body end inward thereby fusing said closure member to said container body, wherein said rolling step includes bending over said portion of said skirt having a reduced thickness and said container body end edge such that said portion of said length having said reduced thickness of said skirt contacts itself.

2. The method of claim 1 wherein said container body is a polypropylene material.

3. The method of claim 1 wherein said closure member skirt is a polypropylene material.

4. The method of claim 1 wherein said closure member skirt has a portion proximate said top edge having a reduced thickness, said reduced thickness having a length.

5. The method of claim 4 wherein said step of heating comprises directing heated air towards said closure member area of said length of said reduced thickness.

6. The method of claim 5 wherein said heated air is applied by a heater device having an heated air distribution manifold.

7. The method of claim 4 wherein said step of heating melts said length of said reduced thickness of said closure member.

8. The method of claim 1 wherein said step of heating begins to fuse said container body and said closure member together prior to said rolling step.

9. The method of claim 1 wherein said step of rolling comprises engaging said skirt top edge and said container body end with a die having a profile with a radius that facilitates rolling of said skirt top edge and said container body end inward.

10. The method of claim 1 wherein said heating step includes melting a portion of said skirt proximate said top edge and a portion of said sidewall of said container body.

11. A method of sealing plastic containers comprising the steps of:

providing a container body having a sidewall and an open end with an end edge;

providing a plug having a body and a peripheral skirt extending therefrom that terminates at an end edge, said peripheral skirt having a first thickness for a first length proximate said body and a second thickness for a second length proximate said end edge, said first thickness being greater than said second thickness;

positioning said plug within said container body open end at an orientation such that said plug skirt end edge is immediately adjacent the container body end edge;

heating said plug skirt end edge and said container body end edge; and rolling said second length of said plug skirt and said container body end edge thereby sealing said container body open end.

12. The method of claim 11 wherein said heating step includes melting a portion of said second length of said plug skirt thereby fusing at least some of said melted portion to said container body.

13. The method of claim 11 wherein said rolling step includes bending over said second length of said plug skirt and said container body end edge such that said second length of said plug skirt contacts itself.

14. A method of sealing plastic containers comprising the steps of:

providing a container body having a sidewall, a first end, and a second end;

providing a closure member having a base with a perimeter and a skirt extending generally perpendicular therefrom, said skirt a base end and a termination end, said skirt having a first thickness for a first length proximate said base end and a second thickness for a second length proximate said termination end, said first thickness being greater than said second thickness;

inserting said closure member into said container body proximate at least one of said ends such that said skirt termination end is flush with one of said ends of said container body;

heating said second length and said container body end thereby melting at least a portion of said skirt thereby fusing said skirt to said sidewall; and rolling said second length of said skirt and said container body end inward thereby fusing said closure member to said container body and wherein a first point along said second length of said skirt contacts a second point along said second length.

* * * * *